US008348539B2

(12) United States Patent
Chu et al.

(10) Patent No.: US 8,348,539 B2
(45) Date of Patent: Jan. 8, 2013

(54) INK PEN WITH FIRESTARTER

(75) Inventors: Jiun-Yu Chu, Taipai Hsien (TW); Morgan Taylor, Kingsport, TN (US)

(73) Assignee: Taylor Brands, LLC, Kingsport, TN (US)

( * ) Notice: Subject to any disclaimer, the term of this patent is extended or adjusted under 35 U.S.C. 154(b) by 321 days.

(21) Appl. No.: 12/833,376

(22) Filed: Jul. 9, 2010

(65) Prior Publication Data

US 2012/0009004 A1 Jan. 12, 2012

(51) Int. Cl.
*B43K 29/00* (2006.01)

(52) U.S. Cl. ..... 401/195; 431/273; 44/507

(58) Field of Classification Search ..... 401/195; 44/506–510; 431/273
See application file for complete search history.

(56) References Cited

U.S. PATENT DOCUMENTS

| | | | | | |
|---|---|---|---|---|---|
| 4,698,068 | A * | 10/1987 | Jensen | 44/507 |
| 4,770,669 | A * | 9/1988 | Allen et al. | 44/510 |
| 5,214,853 | A * | 6/1993 | Bray et al. | 30/183 |
| 5,279,628 | A * | 1/1994 | Hutchens et al. | 44/507 |
| 5,454,657 | A * | 10/1995 | Kim | 401/195 |
| 5,580,239 | A * | 12/1996 | Jang | 431/253 |
| 5,645,415 | A * | 7/1997 | Hamel | 431/153 |
| 5,919,037 | A * | 7/1999 | Brillhart et al. | 431/273 |
| 6,782,576 | B1 * | 8/2004 | Valencic et al. | 7/158 |
| 7,866,840 | B2 * | 1/2011 | Padden | 362/119 |
| 8,186,995 | B2 * | 5/2012 | Putrello, Jr. | 431/273 |
| 2010/0136495 | A1 * | 6/2010 | Weston et al. | 431/274 |

* cited by examiner

*Primary Examiner* — David Walczak
*Assistant Examiner* — Jennifer C Chiang
(74) *Attorney, Agent, or Firm* — Luedeka Neely Group, PC

(57) ABSTRACT

A writing pen, including a writing pen portion; a ferro rod positionable to extend from the writing pen portion; and a striker portion positionable to extend from the writing pen portion to substantially conceal the ferro rod, The striker portion has one or more striker members which may be struck against the ferro rod for generating sparks.

7 Claims, 5 Drawing Sheets

INK PEN WITH FIRESTARTER

FIELD

This disclosure relates to the field of survival tools. More particularly, this disclosure relates to a survival pen configured to enable the generation of sparks for the starting a fire.

BACKGROUND

Many people frequently enjoy participation in outdoor activities such as hiking, backpacking, hunting, and fishing. With an increasing number of people participating in outdoor activities, these people occasionally find themselves stranded or lost in the wilderness. In addition to those seeking outdoor activities, some people find themselves stranded in the wilderness unintentionally, such as those that get lost while driving or in other transportation accidents. When lost in the wilderness, people often find themselves lacking the necessities for survival. One of these necessities is fire. Starting a fire provides a person lost in the wilderness with a source of heat, a method of signaling for help, and a method for preparing food or boiling water.

Various devices have been constructed to provide a source of fire in emergencies. These devices are typically standalone fire starters that a person must remember to carry with them in order for the device to be useful in the event a source of fire is needed. These previous devices also typically have only been useful for starting a fire and have not been combined with any other useful tool. Combining the fire starter with an additional useful tool increases the likelihood that a person will be carrying the device when an emergency situation arises. Accordingly, there is a need for a survival device that functions as both a fire starter and a useful tool that a user is likely to be carrying on themselves in case of an emergency.

The present disclosure provides an ink pen with fire starter for functioning as both a writing instrument and a survival fire starting device, with the ability to remove the fire starting aspect of the pen for functioning solely as a writing instrument.

SUMMARY

The above and other needs are met by a wring pen according to the disclosure which has the ability to be used to start a fire.

In one aspect, the pen includes a writing pen portion; a ferro rod positionable to extend from the writing pen portion; and a striker portion positionable to extend from the writing pen portion to substantially conceal the ferro rod. the striker portion includes one or more striker members which may be struck against the ferro rod for generating sparks.

The striker portion may be removed by a user from the writing pen portion to expose the ferro rod, and the user may manipulate the striker portion to strike one of the striker members against the ferro rod to generate sparks for making a fire.

Pens according to the disclosure are well-suited for carrying as a survival tool on camping trips and other situations where it may become necessary to start a fire. However, the pens have a normal pen appearance and function as a wring pen. In addition, pens according to the disclosure may be configured to remove the ferro rod to reduce both the weight and length of the pen to provide a compact everyday carry pen.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
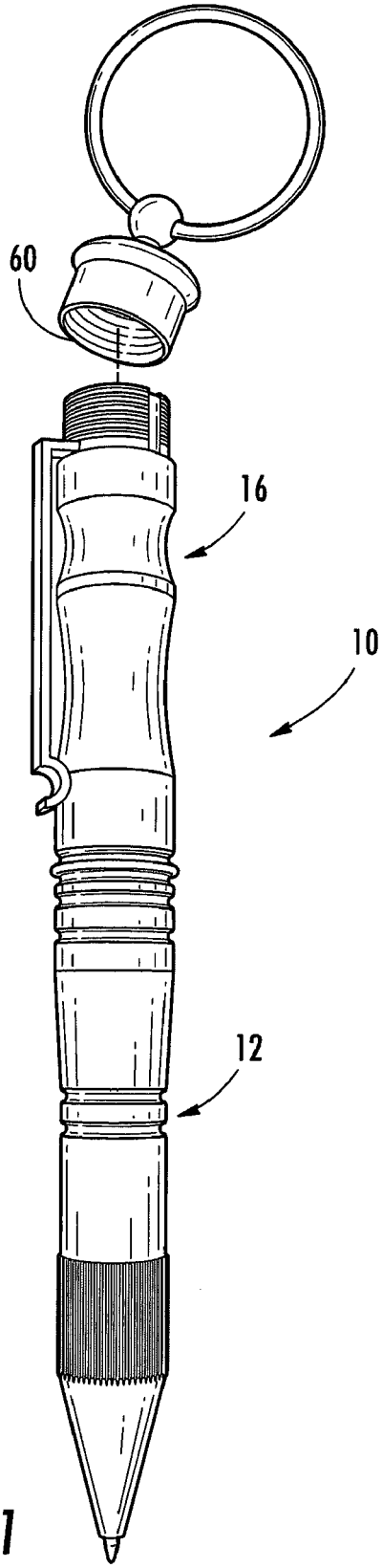
FIG. 1 is a perspective view of a pen according to the disclosure.

With reference to the drawings, the disclosure relates to an ink pen 10 including a writing pen portion 12, a ferro rod 14, and a striker portion 16. The pen 10 is well-suited for carrying as a survival tool on camping trips and other situations where it may become necessary to start a fire. The pen 10 is also devoid of any combustibles so as to not be subject to travel restrictions.

The structure of the pen 10 enables a person to carry a writing utensil that may serve as a fire starter by striking structure associated with the stiker portion 16 against the ferro rod 14 to create a spark. The pen 10 is also advantageously configured to allow the ferro rod 14 and striker portion 16 to be removed from the pen 10 to leave just the pen portion 12, but in an aesthetically pleasing configuration which is suitable for everyday carry when the need for the fire starting function is not anticipated.

The writing pen portion 12 includes a pair of housings 18 and 20, an ink pen cartridge 22, and a spring 24. The housings 18 and 20 are preferably of a hard material such as steel, titanium, or a hardened plastic.

The housing 18 is generally cylindrical to receive an upper portion of the ink pen cartridge 22 therein and includes an upper externally threaded neck end 30 and a lower internally threaded open end 32. The external threads of the neck end 30 are configured to threadably mate with the striker portion 16 as described below. The neck end 30 is also configured to fixedly engage a portion of the ferro rod 14. In this regard, a distalmost upper surface 34 of the neck end 30 may include a centrally located threaded aperture for threadably receiving a corresponding threaded end 36 of the ferro rod 14.

The housing 20 is generally cylindrical to receive a lower portion of the ink pen cartridge 22 therein and includes an upper externally threaded neck end 40 and a lower open end 42 through which the lowermost portion of the ink cartridge 22 may extend for writing purposes. The externally threaded neck end 40 of the housing 20 threadably mates with the internally threaded open end 32 to enable the housing 18 to be threadably installed onto the housing 20, with the length axis of each aligned. The threadable joinder of the housings 18 and 20 also enables relative adjustment thereof, such that the lowermost portion of the ink cartridge 22 may be extended through the open end 42 or retracted therethrough by rotational adjustment of the housing 20 relative to the housing 18. The joinder of the housings 18 and 20 may be fluidly sealed if desired, as by incorporation of an o-ring 44 at the threaded connection thereof.

Figure 3:
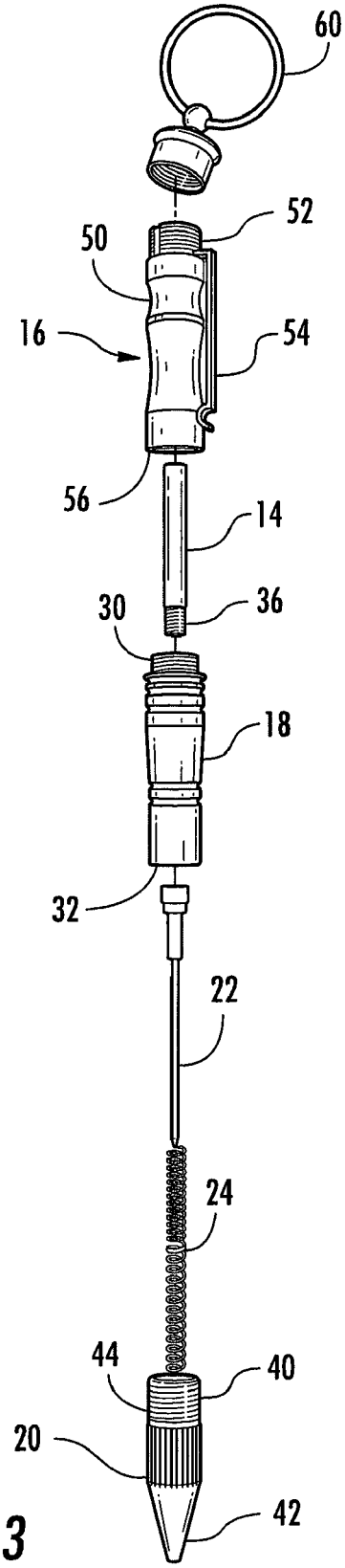
FIG. 3 is an exploded view of the pen according to the disclosure.

With respect to FIG. 3, the ferro rod 14 is preferably constructed from ferrocerium or other flint-like metallic materials used for creating a spark. The ferro rod 14 is also preferably configured in a cylindrical shape, however, it is also understood that the ferro rod 14 may be in a rectangular or other configuration compatible with the structure of the pen 10. When the ferro rod 14 is attached to the housing 18, as by threading the threaded end 36 thereof into the neck 30 of the housing 18, the ferro rod 14 is rigidly maintained relative to the housing 18 with the length axis of the ferro rod 18 aligned with the aligned length axes of the housings 18 and 20.

The striker portion 16 includes a housing 50 and a striker member 52 and/or a striker member 54 located on the housing 50. The housing 50 is generally cylindrical to fit over and conceal the ferro rod 14. The housing 50 includes a lower internally threaded open end 56 which may the threaded onto the external threads of the neck end 30 of the housing 18 to install the housing 50 onto the upper end of the housing 18.

Figure 4:
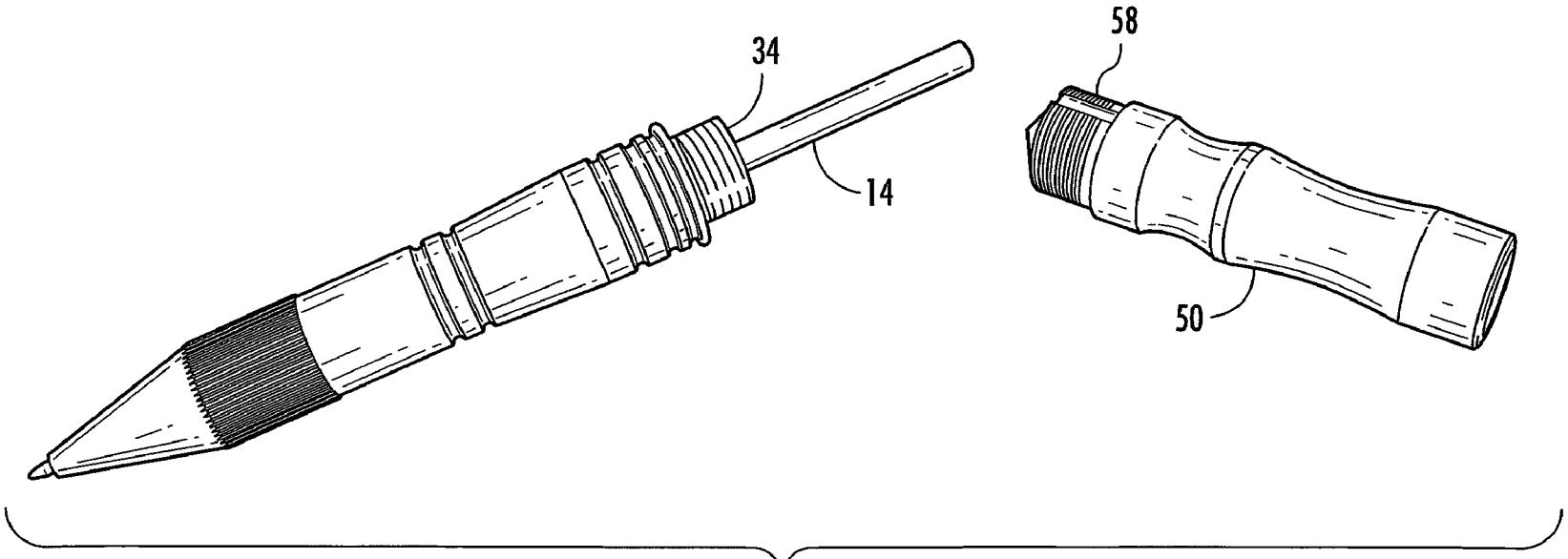
FIG. 4 is a perspective view of a pen according to the disclosure where the striker is exposed.

The striker member 52 is made of a metal or other material suitable for contacting the ferro rod 14 to produce a spark. The striker member 52 is located at the upper end of the housing 50 and includes one or more edges 58 configured so that when the edges 58 are vigorously struck against the ferro rod 14, a spark may result (see generally, FIG. 4). The edges 58 have a decorative appearance and, if left uncovered, give no visual indication of the fire starting capabilities of the pen 10. The striker member 52 may be constructed of a hardened metal such as steel. If desired, the edges 58 may be configured as threads to enable a protective cap 60 to be installed over the striker member 52. The cap 60 may include a key ring or be otherwise decorative.

Figure 2B:
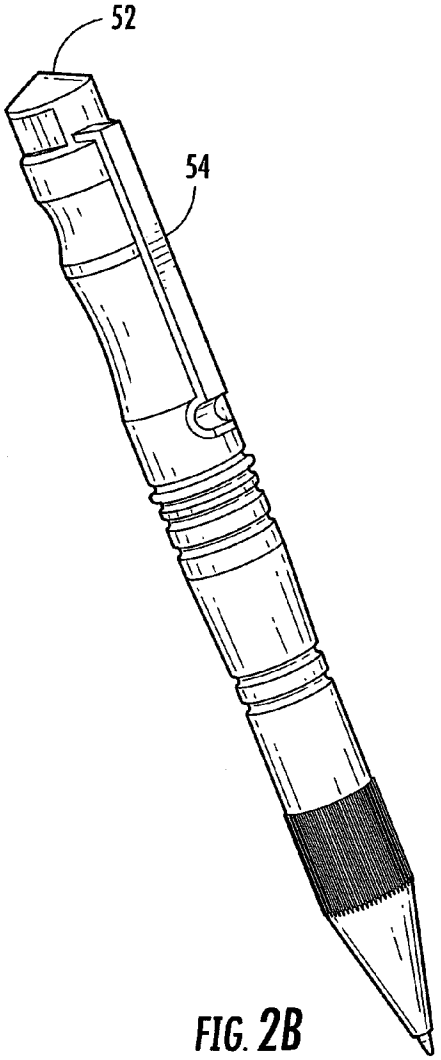
FIGS. 2A and 2B are perspective views of a pen including a clip that functions as a striker according to one embodiment of the disclosure.
Figure 2A:
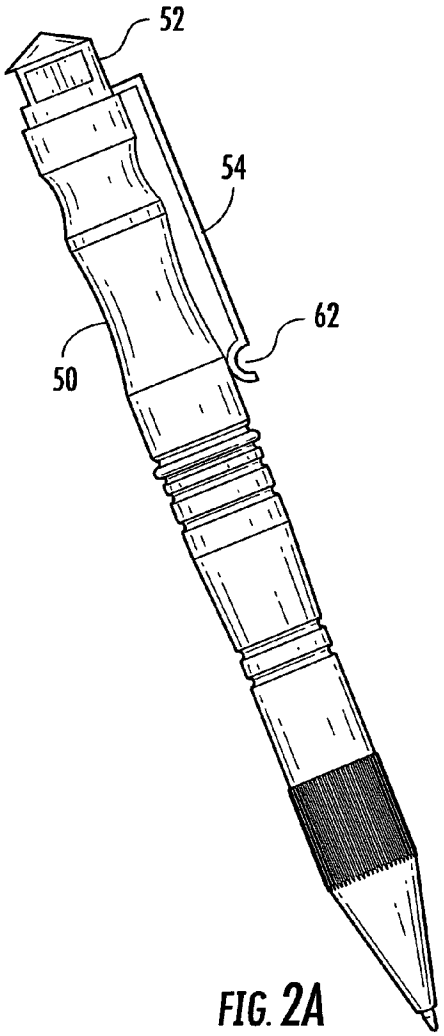

The striker member 54 is also made of a suitable material to generate sparks when struck against the ferro rod 14 and may be configured to serve as a clip to allow the pen 10 to be attached to a shirt pocket. With reference to FIGS. 2A and 2B, the striker member 54 configured as a shirt clip may include a semi-circular indentation 62 for contacting the ferro rod 14. The semi-circular indentation 62 may be shaped such that it conforms to the shape of the ferro rod 14, allowing the striker member 54 to stay in contact with the ferro rod 14. The striker member 54 is externally visible, yet appears substantially as a shirt clip and gives no visual indication of the fire starting capabilities of the pen 10.

When fully assembled, the pen 10 appears as a writing pen and no visual indication is given that it is has fire starting components. In use, the pen 10 functions as an ordinary writing pen. In a situation where a fire is desired, the pen 10 enables the creation of a spark for lighting flammable materials. To create a spark, a user may unthread the housing 50 to expose the ferro rod 14. Holding the removed housing 50 in one hand, and the remaining structure with the ferro rod 14 in the other hand, the user may strike either the striker member 52 or the striker member 54 against the ferro rod to generate sparks for making a fire. If the cap 60 is provided on the housing 50, it is removed if the striker 52 is to be used.

For example, the edges 58 of the striker member 52 may, with constant firm pressure, be moved along the length of the ferro rod 14. By pressing down on the striker member 52 while moving down the length of the ferro rod 14, friction is caused which enables the creation of sparks. The striker member 52 may be repeatedly moved along the length of the ferro rod 14 until sufficient sparks have formed to ignite a flammable material. For example, tender, such as dry grass, birch bark, or other relatively easy to light material may be ignited with the resulting sparks and a larger fire made therefrom. After a fire is created, the housing 50 may be threaded on to the housing 20 and the top cap 36 threaded over the striker 16 to return the pen 10 to its original configuration.

In a similar manner for the striker member 54, the semi-circular indentation 62 is placed adjacent the ferro rod 14 so that the ferro rod rests within the semi-circular indentation 62. The member 54 may then be moved rapidly against the ferro rod 14 along its length causing friction and sparks.

Figure 5:
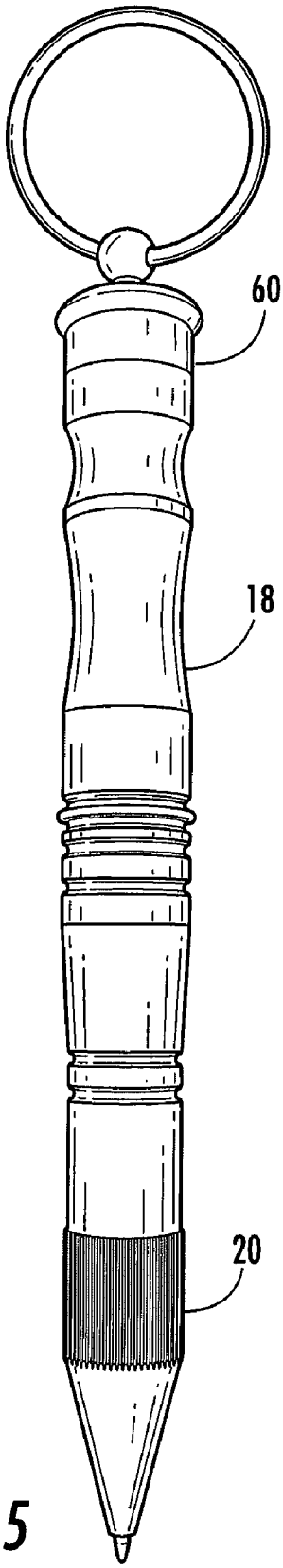
FIG. 5 is a perspective view of a pen according to the disclosure where the fire starting portion has been removed.

Additionally, with respect to FIG. 5, the pen 10 may be configured for everyday use without the presence of the ferro rod 14 or striker 16. In this configuration, the ferro rod 14 and the housing 50 are unthreaded from the housing 18. The cap 60 may then be directly threaded to the upper neck end 40 of the housing 20. The resulting configuration is smaller and easier to carry for regular use.

Accordingly, it will be appreciated that the structure of the pen 10 enables the creation of sparks from the ferro rod 14 and the striker portion associated with the pen 10. The structure is also advantageously configured to enable the fire-starting structure of the pen 10 to be removed enabling the pen 10 to be smaller and easier to carry for regular use.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A writing pen, comprising:

a writing pen portion;

a ferro rod extending from the writing pen portion; and a removable striker portion extending from the writing pen portion and overlying the ferro rod to substantially conceal the ferro rod, the striker portion including one or more striker members which may be struck against the ferro rod for generating sparks, wherein, the striker portion may be removed by a user from the writing pen portion to expose the ferro rod, and the user may manipulate the striker portion to strike one of the striker members against the ferro rod to generate sparks for making a fire.

2. The pen of claim 1, wherein the striker portion comprises a housing that fits onto the writing pen portion and over the ferro rod.

3. The pen of claim 2, wherein the housing includes a striker member located at the upper end of the housing, and the first striker member includes one or more edges configured so that when the edges are struck against the ferro rod, a spark may result.

4. The pen of claim 2, wherein the housing includes a striker member on the exterior thereof configured as a shirt clip.

5. The pen of claim 1, wherein the ferro rod is removable from the writing pen portion to substantially configure the pen for everyday carrying without the ability to start a fire.

6. The pen of claim 1, wherein the writing pen portion comprises a first housing and a pen cartridge within the housing, and the ferro rod is mountable to extend upwardly from the pen housing, and the striker portion comprises a second housing that fits onto the first housing and over the ferro rod.

7. The pen of claim 4, wherein the striker member configured as a shirt clip includes a semi-circular indentation shaped to conform to the ferro rod.

* * * * *